US008758476B2

(12) United States Patent
Arakawa et al.

(10) Patent No.: US 8,758,476 B2
(45) Date of Patent: Jun. 24, 2014

(54) METHOD OF PRODUCING MIXED POWDER COMPRISING NOBLE METAL POWDER AND OXIDE POWDER, AND MIXED POWDER COMPRISING NOBLE METAL POWDER AND OXIDE POWDER

(75) Inventors: Atsutoshi Arakawa, Ibaraki (JP); Kazuyuki Satoh, Ibaraki (JP); Atsushi Sato, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 836 days.

(21) Appl. No.: 12/993,133

(22) PCT Filed: Aug. 18, 2009

(86) PCT No.: PCT/JP2009/064438

§ 371 (c)(1),
(2), (4) Date: Jan. 10, 2011

(87) PCT Pub. No.: WO2010/024150

PCT Pub. Date: Mar. 4, 2010

(65) Prior Publication Data

US 2011/0114879 A1 May 19, 2011

(30) Foreign Application Priority Data

Aug. 28, 2008 (JP) ..... 2008-219133

(51) Int. Cl.

| | |
|---|---|
| ***B22F 9/30*** | (2006.01) |
| ***C22B 11/00*** | (2006.01) |
| ***C22B 11/02*** | (2006.01) |
| ***C22C 1/10*** | (2006.01) |
| ***C22C 5/04*** | (2006.01) |

(52) U.S. Cl.

USPC ..... 75/369; 75/343; 75/363; 75/392; 75/710; 75/232; 75/235; 75/247; 419/19; 419/20; 419/21; 419/22; 419/32; 252/182.33; 204/290.08; 204/290.09

(58) Field of Classification Search

None

See application file for complete search history.

(56) References Cited

U.S. PATENT DOCUMENTS

| | | | | |
|---|---|---|---|---|
| 2,732,349 | A * | 1/1956 | Bilisoly et al. | 502/223 |
| 3,660,053 | A * | 5/1972 | Palme | 378/143 |
| 4,094,821 | A * | 6/1978 | McVicker et al. | 502/328 |
| 4,141,817 | A * | 2/1979 | McVicker et al. | 208/139 |
| 5,623,725 | A | 4/1997 | Disam et al. | |
| 2010/0276276 | A1 | 11/2010 | Takami et al. | |
| 2011/0114879 | A1 * | 5/2011 | Arakawa et al. | 252/182.33 |

FOREIGN PATENT DOCUMENTS

| | | | |
|---|---|---|---|
| JP | 62-107001 | A | 5/1987 |
| JP | 02-294416 | A | 12/1990 |
| JP | 2003-313659 | A | 11/2003 |
| JP | 2006-176810 | A | 7/2006 |
| JP | 2008-095174 | A | 4/2008 |
| JP | 2008-106349 | A | 5/2008 |

* cited by examiner

*Primary Examiner* — Joseph D Anthony

(74) *Attorney, Agent, or Firm* — Howson & Howson LLP

(57) ABSTRACT

Provided are a method of producing mixed powder comprising noble metal powder and oxide powder, wherein powder of ammonium chloride salt of noble metal and oxide powder are mixed, the mixed powder is subsequently roasted, and ammonium chloride is desorbed by the roasting process in order to obtain mixed powder comprising noble metal powder and oxide powder, and mixed powder comprising noble metal powder and oxide powder, wherein chlorine is less than 1000 ppm, nitrogen is less than 1000 ppm, 90% or more of the grain size of the noble metal powder is 20 μm or less, and 90% or more of the grain size of the oxide powder is 12 μm or less. Redundant processes in the production of noble metal powder are eliminated, and processes are omitted so that the inclusion of chlorine contained in the royal water and nitrogen responsible for hydrazine reduction reaction is eliminated as much as possible. Consequently, the present invention aims to omit the drying process at a high temperature and thereby prevent grain growth and aggregation, and further eliminate the pulverization and classification processes in order to considerably reduce the production cost.

12 Claims, No Drawings

METHOD OF PRODUCING MIXED POWDER COMPRISING NOBLE METAL POWDER AND OXIDE POWDER, AND MIXED POWDER COMPRISING NOBLE METAL POWDER AND OXIDE POWDER

BACKGROUND OF THE INVENTION

The present invention relates to mixed powder comprising noble metal powder and oxide powder to be used as a raw material upon producing a target of a component containing noble metal and oxide, and to its production method, and in particular relates to a method of inexpensively producing mixed powder comprising noble metal powder and oxide powder, and the obtained mixed powder comprising noble metal powder and oxide powder A target of a component containing noble metal and oxide as represented with a (Co—Cr—Pt)+$SiO_2$ target is being used as a sputtering target for a recording layer of a magnetic recording medium. In order to produce this target, noble metal powder (fine powder) is required.

The conventional method of producing noble metal fine powder is as follows when taking platinum as an example. Foremost, a platinum raw material (for instance, platinum scrap) is dissolved in royal water, and the residue that did not dissolve in the royal water is filtered and removed. After the filtering and removal process, this is heated in order to denitrate nitric acid from the royal water to obtain a chloroplatinic aqueous solution. Subsequently, this is reacted with ammonium chloride to obtain a solid ammonium chloroplatinate. Moreover, the ammonium chloroplatinate is roasted to desorb ammonium chloride, whereby obtained is sponge-like platinum.

Subsequently, the sponge-like platinum is once again dissolved in royal water to obtain a chloroplatinic aqueous solution, pH in the liquid is adjusted to be neutral to alkaline, and platinum is deposited based on the reduction reaction of adding hydrazine.

The foregoing platinum can be made into fine powder by adjusting the reduction reaction conditions, and the intended fine platinum powder can be produced through the processes of filtering and removal, cleaning and drying.

In the foregoing process, the processes from "sponge-like platinum is once again dissolved in royal water" onward are the processes for producing the fine platinum powder, and entail increased costs.

In addition, there is also a problem in that the chlorine contained in the royal water and nitrogen responsible for the hydrazine reduction reaction will remain as impurities in the fine platinum powder. The processes of heating and drying are required for sufficiently eliminating the foregoing impurities, and if the condition is set to a high temperature, grain growth and aggregation will occur.

Powder that was subject to grain growth or aggregation during the drying process as described above will further require the pulverization and classification processes. Meanwhile, if low temperature drying is performed, since degassing will be insufficient, not only will the warm-water cleaning and re-drying processes become required, although this will have some effect on the chlorine, there will hardly be any effect on the nitrogen. Thus, the conventional process has a problem that the production cost for obtaining fine powder of noble metals becomes high.

Moreover, as a similar method of producing platinum powder, disclosed is a method of producing platinum powder by simultaneously adding chloroplatinic aqueous solution and ammonia hydrazine aqueous solution in an ammoniacal aqueous solution (refer to Patent Document 1).

In the foregoing case, the method of producing the powder in a solution is being adopted. Consequently, the obtained platinum powder must be subject to suction filtration, subsequently dried, further baked at 350 to 600° C., and gas components such as chlorine adsorbed on the platinum powder must be removed.

Moreover, in order to perform dechlorination, the processes of warm-water cleaning, drying, and pulverization are required.

Since the foregoing processes are indispensible for reactions in a solution, the processes become much more complicated and push up the production cost.

As a similar method of producing platinum powder, disclosed is a method of producing platinum powder by simultaneously adding an ammonia hydrazine aqueous solution in the chloroplatinic aqueous solution (Patent Document 2).

In the foregoing case also, the method of producing the powder in a solution is being adopted. Consequently, the obtained platinum powder must be cleaned, subject to suction filtration, and subsequently dried, but the foregoing processes alone will not be able to sufficiently eliminate the chlorine and nitrogen remaining as impurities in the platinum powder.

The processes of heating and drying are required for sufficiently eliminating the foregoing impurities, and if the condition is set to a high temperature, grain growth and aggregation will occur. Powder that was subject to grain growth or aggregation during the drying process as described above will further require the pulverization and classification processes. Thus, the processes become much more complicated and cause the production cost to increase.

[Patent Document 1] Japanese Published Unexamined Application No. 2008-95174

[Patent Document 2] Japanese Published Unexamined Application No. H02-294416

SUMMARY OF THE INVENTION

Problems which the Invention Intends to Solve

The present invention was devised in view of the foregoing problems, and an object of this invention is to avoid, in the foregoing process, redundant processes in the production of noble metal powder and omit processes so that the inclusion of chlorine contained in the royal water and nitrogen responsible for hydrazine reduction reaction is eliminated as much as possible. Consequently, the present invention aims to omit the drying process at a high temperature and thereby prevent grain growth and aggregation, and further eliminate the pulverization and classification processes in order to considerably reduce the production cost.

Means for Solving the Problems

As a result of intense study to achieve the foregoing object, the present inventors discovered that it is extremely effective in terms of cost reduction to produce, from the very beginning, mixed powder of noble metal powder and oxide powder by mixing powder of ammonium chloride salt of noble metal and oxide powder, and subsequently roasting the mixed powder.

Based on the foregoing discovery, the present invention provides:

1) A method of producing mixed powder comprising noble metal powder and oxide powder, wherein powder of ammonium chloride salt of noble metal and oxide powder are mixed, the mixed powder is subsequently roasted, and ammonium chloride is desorbed by the roasting process in order to obtain mixed powder comprising noble metal powder and oxide powder.

This process is the core of this invention. The noble metal powder that is obtained with the foregoing production method is obtained as a mixture with oxide powder, but conventionally, a method of producing mixed powder comprising noble metal powder and oxide powder did not exist, nor was there any such concept.

As described later, based on the foregoing process, it is possible to omit the drying process at a high temperature and thereby prevent grain growth and aggregation, and further eliminate the pulverization and classification processes in order to considerably reduce the production cost. Moreover, it is possible to omit processes so that the inclusion of chlorine contained in the royal water and nitrogen responsible for hydrazine reduction reaction is eliminated as much as possible.

The present invention additionally provides:

2) The method of producing mixed powder comprising noble metal powder and oxide powder according to paragraph 1) above, wherein 90% or more of the grain size of the noble metal powder is 20 μm or less, and 90% or more of the grain size of the oxide powder is 12 μm or less.
3) The method of producing mixed powder comprising noble metal powder and oxide powder according to paragraph 1) and paragraph 2) above, wherein roasting is performed in the atmosphere at a roasting temperature of 350° C. or higher and 800° C. or less.
4) The method of producing mixed powder comprising noble metal powder and oxide powder according to paragraph 1) and paragraph 2) above, wherein roasting is performed in a hydrogen-containing gas atmosphere at a roasting temperature of 100° C. or higher and 500° C. or less.
5) The method of producing mixed powder comprising noble metal powder and oxide powder according to any one of paragraphs 1) to 4) above, wherein the volume of oxide to be added as a raw material is 3% to 35% of the volume of the ammonium chloride salt of the noble metal.
6) The method of producing mixed powder comprising noble metal powder and oxide powder according to any one of paragraphs 1) to 5) above, wherein the noble metal is at least one type among platinum, gold, iridium, palladium, and ruthenium.
7) The method of producing mixed powder comprising noble metal powder and oxide powder according to any one of paragraphs 1) to 6) above, wherein the oxide is at least one type among lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide, molybdenum oxide, indium oxide, tin oxide, hafnium oxide, tantalum oxide, tungsten oxide, and bismuth oxide.

The present invention additionally provides:

8) Mixed powder comprising noble metal powder and oxide powder, wherein chlorine is less than 1000 ppm, nitrogen is less than 1000 ppm, 90% or more of the grain size of the noble metal powder is 20 μm or less, and 90% or more of the grain size of the oxide powder is 12 μm or less.

The foregoing chlorine content and nitrogen content can be achieved by the present invention, and both impurities can be further reduced to 500 ppm or less, and even 200 ppm or less.

The present invention additionally provides:

9) The mixed powder comprising noble metal powder and oxide powder according to paragraph 8) above, wherein the noble metal is at least one type among platinum, gold, iridium, palladium, and ruthenium
10) The mixed powder comprising noble metal powder and oxide powder according to paragraph 8) or paragraph 9) above, wherein the oxide is at least one type among lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide, molybdenum oxide, indium oxide, tin oxide, hafnium oxide, tantalum oxide, tungsten oxide, and bismuth oxide.

Effect of the Invention

According to the present invention, it is possible to avoid redundant processes in the production of noble metal powder and omit processes so that the inclusion of chlorine contained in the royal water and nitrogen responsible for hydrazine reduction reaction is eliminated as much as possible. Consequently, the present invention yields a superior effect of being able to omit the drying process at a high temperature and thereby prevent grain growth and aggregation, and further eliminate the pulverization and classification processes in order to considerably reduce the production cost.

DETAILED DESCRIPTION OF THE INVENTION

The method of producing mixed powder comprising noble metal powder and oxide powder to become a raw material for use in a sputtering target according to the present invention mixes oxide at the stage of the ammonium chloride salt and subsequently roasts the mixture. The mixing method may be the mixture of ammonium chloride salt and oxide in a solution, or dried ammonium chloride salt and oxide may be placed in a container and directly mixed.

Since it is thereby possible to desorb the ammonium chloride and obtain a mixture of noble metal powder and oxide powder, the processes can be considerably shortened in comparison to conventional production methods, and a significant cost reduction can be achieved. Nevertheless, this is first and foremost mixed powder of noble metal powder and oxide powder as described above.

Under normal circumstances, a raw material to be used in a sputtering target for a recording layer of a magnetic recording medium uses a mixed material of noble metal powder and oxide. And, there is no problem in using mixed powder of noble metal powder and oxide powder as the raw material and, rather, it could be said that prior mixing of the powders is effective.

The reason why the oxide fine powder is mixed before the roasting process is to prevent the aggregation of the noble metals in the roasting process. Upon producing a sputtering target for a recording layer of a magnetic recording medium, it is necessary to refine the structure, prevent the generation of abnormal discharge and particles, and the grain size of noble metals and the grain size of oxide must be fine in order to seek the improvement in quality.

In light of the above, 90% or more of the grain size of the noble metal powder is made to be 20 μm or less, and 90% or more of the grain size of the oxide powder is made to be 12 μm or less. Preferably, 90% or more of the grain size of the noble metal powder is made to be 10 μm or less, and 90% or more of the grain size of the oxide powder is made to be 6 μm or less. As described above, it is thereby possible to limit the range of aggregation of the noble metals in the roasting process. Specifically, upon performing roasting in the atmosphere, it is desirable to set the roasting temperature to be 350° C. or higher, more preferably in a range of 350° C. to 500° C.

If the temperature is less than 350° C., it is difficult for the ammonium chloride to desorb, and the chlorine content and nitrogen content in the obtained fine powder will increase. In addition, the time required for desorption will become extremely long and a problem will also arise in terms of productivity.

Meanwhile, the purpose that the temperature is set to be 800° C. or less is in order to inhibit the grain growth of the noble metal fine powder, as well as to prevent the occurrence of aggregation and grain growth of the oxide powder.

Incidentally, when performing roasting in a hydrogen-containing gas atmosphere, the temperature may be low. Specifically, roasting may be performed at a roasting temperature of 100° C. or higher and 500° C. or less. In the hydrogen gas atmosphere, since hydrogen assists the reaction for decomposing ammonium chloride from ammonium chloroplatinate and roasting progresses rapidly, roasting at a temperature that is lower than a normal roasting temperature is possible.

Making 90% or more of the grain size of the noble metal powder 20 μm or less, and 90% or more of the grain size of the oxide powder 12 μm or less can be easily achieved by setting 90% or more of the grain size of the ammonium chloride salt powder of the noble metal to become the raw material to be 30 μm or less, and setting 90% or more of the grain size of the oxide powder to be 12 μm or less.

For example, upon desorbing ammonium chloride from ammonium chloroplatinate, the grain size will be approximately from 30 μm to 10 μm. Here, although slight grain growth will occur due to the influence of the temperature in the roasting process, the degree thereof will differ depending on the temperature.

As described above, if the roasting temperature exceeds 800° C., it will normally become noble metal powder having a grain size exceeding 20 μm. Nevertheless, if the grain size of ammonium chloroplatinate is sufficiently small, even if roasting is performed at a temperature exceeding 800° C., there are cases where the grain size of the noble metal powder will not reach 20 μm.

Similarly, when setting the grain size of oxide to be 12 μm or less, grain growth caused by roasting is expected. Thus, when setting 90% or more of the grain size of the noble metal to 20 μm or less, and 90% or more of the grain size of the oxide powder to 12 μm or less, the roasting temperature range of 350° C. to 800° C. is the recommended temperature.

The volume of oxide to be added as a raw material is 3% to 35% of the volume of the ammonium chloride salt of the noble metal.

Since the noble metal fine powder will easily aggregate in the roasting process if the oxide powder is not in the vicinity of the ammonium chloride salt powder of the noble metal, oxide powder is added so that the volume will be 3% or more. If it is added in excess of 35%, it will not be a practical mixing ratio as a raw material for a sputtering target of a recording layer of a magnetic recording medium. Accordingly, it is desirable to keep the volume of oxide to be within the foregoing range.

The foregoing is particularly effective when using platinum, but it should be naturally understood that the present invention can also be applied to cases of using at least one type of noble metal among platinum, gold, iridium, palladium, and ruthenium.

In addition, at least one type of oxide among lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide, molybdenum oxide, indium oxide, tin oxide, hafnium oxide, tantalum oxide, tungsten oxide, and bismuth oxide may be used.

With the mixed powder comprising noble metal powder and oxide powder of the present invention obtained as described above, chlorine of less than 1000 ppm and nitrogen of less than 1000 ppm can also be achieved.

It is possible to achieve a chlorine content of 500 ppm or less, 200 ppm or less, and even 100 ppm or less. Similarly, it is possible to achieve a nitrogen content of 500 ppm or less, and even 200 ppm or less.

EXAMPLES

The Examples of the present invention are now explained. These Examples are merely illustrative, and the present invention shall in no way be limited thereby. That is, various modifications and other embodiments based on the technical spirit shall be included in the present invention as a matter of course.

Example 1

Platinum scrap was dissolved in acid, the residue was filtered and removed, and the solution and ammonium chloride were reacted to produce ammonium chloroplatinate.

Subsequently, the ammonium chloroplatinate that was obtained in the refining process of the platinum scrap was mixed with $SiO_2$.

The mixing ratio was, based on volume conversion, ammonium chloroplatinate 10 to $SiO_2$ 1. As the mixing method, the mixture was placed in a mortar and sufficiently agitated. The mixture was thereafter placed in a quartz container, which was placed in a roasting furnace, and roasted in the atmosphere at 600° C. for 20 hours to desorb ammonium chloride.

As a result of analyzing the mixture after the roasting process, chlorine was <100 ppm and nitrogen was 500 ppm, and it was confirmed that there is no residual ammonium chloride. As a result of measuring the grain size distribution (using a laser diffraction/scattering type analyzer manufactured by HORIBA), 90% or more of the grain size of the platinum powder was 3 to 10 μm. Moreover, 90% or more of the grain size of the $SiO_2$ powder was 0.5 to 3 μm.

Upon preparing a Co—Cr—Pt—$SiO_2$ target with the mixed powder after the roasting process as the raw material, a prescribed amount of Co powder and Cr powder was added, and $SiO_2$ powder was additionally added to supply the deficiency, and these powders were mixed and sintered.

Generally, when using Co—Cr—Pt—$SiO_2$ as a recording medium, it is used upon adjusting the respective components to be a prescribed ratio. The adjustment of components; that is, the deficient materials may be added as needed. The components may be similarly adjusted in Examples and Comparative Examples.

The structure of a sintered compact was fine, and a favorable sputtering target for forming a recording layer film of a magnetic recording medium was obtained.

Comparative Example 1

The following Comparative Examples are not conventional technology. This is because there is no conventional technology that is similar to the present invention. The Comparative Examples show examples other than the conditions of the desirable range of the dependent claims that are defined in the claims. Accordingly, it should be understood that these conditions are not be considered an exclusion factor of the scope of claims that is defined as a broader concept of the present invention.

When the roasting conditions were set so that roasting is performed in the atmosphere at 900° C. for 20 hours, although the chlorine content and nitrogen content were sufficiently low, the grain size of platinum of 20 μm or larger accounted for approximately 30%, and was slightly increased. Here, even when a target was prepared using this raw material, the desired favorable fine structure could not be obtained. Contrarily, when the roasting conditions were set so that roasting is performed in the atmosphere at 300° C. for 20 hours, the ammonium chloride did not completely desorb, and in this case the desired favorable platinum powder could not be obtained either. Accordingly, it is evident that the desirable condition upon roasting is to set the temperature to 350° C. or higher and 800° C. or less.

Comparative Example 2

In foregoing Example 1, the mixing ratio was, based on volume conversion, ammonium chloroplatinate 10 to $SiO_2$ 0.2; that is, 2%. As a result of observing the mixed powder after roasting with a microscope, large aggregation of platinum powder could be seen in spots. This is considered to be because the ratio of the oxide powder was low, and the noble metal powders are easily aggregated in the roasting process.

Example 2

Ruthenium-containing scrap was dissolved in acid, the residue was filtered and removed, and the solution and ammonium chloride were reacted to produce ammonium ruthenium chloride acid. Subsequently, the ammonium ruthenium chloride acid obtained in the refining process of the ruthenium scrap was mixed with SiO2.

The mixing ratio was, based on volume conversion, ammonium ruthenium chloride acid 10 to $SiO_2$ 1. As the mixing method, the mixture was placed in a mortar and sufficiently agitated. The mixture was thereafter placed in a quartz container, which was placed in a roasting furnace, and roasted in the atmosphere at 600° C. for 20 hours to desorb ammonium chloride.

As a result of analyzing the mixture after the roasting process, chlorine was <100 ppm and nitrogen was 500 ppm, and it was confirmed that there is no residual ammonium chloride. As a result of measuring the grain size distribution (using a laser diffraction/scattering type analyzer manufactured by HORIBA), 90% or more of the grain size of the ruthenium powder was 3 to 10 μm. Moreover, 90% or more of the grain size of the $SiO_2$ powder was 0.5 to 3 μm.

Upon preparing a Co—Ru—$SiO_2$ target with the mixed powder after the roasting process as the raw material, a prescribed amount of Co powder was added, and $SiO_2$ powder was additionally added to supply the deficiency, and these powders were mixed and sintered.

The structure of a sintered compact was fine, and a favorable sputtering target for forming a recording layer film of a magnetic recording medium was obtained.

Example 3

The ammonium chloroplatinate obtained in the refining processing of the platinum scrap of foregoing Example 1 and $TiO_2$ were mixed. The mixing ratio was, based on volume conversion, ammonium chloroplatinate 10 to $TiO_2$ 1.

As the mixing method, the mixture was placed in a mortar and sufficiently agitated. The mixture was thereafter placed in a quartz container, which was placed in a roasting furnace, and roasted in the atmosphere at 600° C. for 20 hours to desorb ammonium chloride.

As a result of analyzing the mixture after the roasting process, chlorine was <100 ppm and nitrogen was 500 ppm, and it was confirmed that there is no residual ammonium chloride. As a result of measuring the grain size distribution (using a laser diffraction/scattering type analyzer manufactured by HORIBA), 90% or more of the grain size of the platinum powder was 3 to 10 μm. Moreover, 90% or more of the grain size of the $TiO_2$ powder was 0.5 to 3 μm.

Upon preparing a Co—Cr—Pt—$TiO_2$ target with the mixed powder after the roasting process as the raw material, a prescribed amount of Co powder and Cr powder was added, and titanium oxide ($TiO_2$) powder was additionally added to supply the deficiency, and these powders were mixed and sintered.

The structure of a sintered compact was fine, and a favorable sputtering target for forming a recording layer film of a magnetic recording medium was obtained.

Although the foregoing Examples used two examples as oxides; namely, silicon oxide and titanium oxide, including silicon oxide and titanium oxide, similar results were obtained by adding at least one type among lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide, molybdenum oxide, indium oxide, tin oxide, hafnium oxide, tantalum oxide, tungsten oxide, and bismuth oxide.

Example 4

Platinum scrap was dissolved in acid, the residue was filtered and removed, and the solution and ammonium chloride were reacted to produce ammonium chloroplatinate. Subsequently, the ammonium chloroplatinate that was obtained in the refining process of the platinum scrap was mixed with $SiO_2$.

The mixing ratio was, based on volume conversion, ammonium chloroplatinate 100 to $SiO_2$ 32. As the mixing method, the mixture was placed in a mortar and sufficiently agitated. The mixture was thereafter placed in a quartz container, which was placed in a roasting furnace, and roasted in the atmosphere at 400° C. for 10 hours to desorb ammonium chloride.

As a result of analyzing the mixture after the roasting process, chlorine was <100 ppm and nitrogen was 500 ppm, and it was confirmed that there is no residual ammonium chloride. As a result of measuring the grain size distribution (using a laser diffraction/scattering type analyzer manufactured by HORIBA), 90% or more of the grain size of the platinum powder was 7 to 16 μm. Moreover, 90% or more of the grain size of the $SiO_2$ powder was 0.5 to 3 μm.

Upon preparing a Co—Cr—Pt—$SiO_2$ target with the mixed powder after the roasting process as the raw material, a prescribed amount of Co powder and Cr powder was added, and $SiO_2$ powder was additionally added to supply the deficiency, and these powders were mixed and sintered.

The structure of a sintered compact was fine, and a favorable sputtering target for forming a recording layer film of a magnetic recording medium was obtained.

Although the foregoing Examples used platinum and ruthenium, including the foregoing noble metals, similar results were obtained upon using at least one type among platinum, gold, ruthenium, palladium, and iridium.

The present invention is able to avoid redundant processes in the production of noble metal powder and omit processes so that the inclusion of chlorine contained in the royal water and nitrogen responsible for hydrazine reduction reaction is eliminated as much as possible. Consequently, the present invention yields a superior effect of being able to omit the drying process at a high temperature and thereby prevent grain growth and aggregation, and further eliminate the pulverization and classification processes in order to considerably reduce the production cost. Thus, the present invention is particularly effective as a sputtering target for a recording layer of a magnetic recording medium.

The invention claimed is:

1. A method of producing mixed powder comprising noble metal powder and oxide powder, wherein powder of ammonium chloride salt of noble metal and oxide powder are mixed, the mixed powder is subsequently roasted, and ammonium chloride is desorbed by the roasting process in order to obtain mixed powder comprising noble metal powder and oxide powder.

2. The method of producing mixed powder comprising noble metal powder and oxide powder according to claim 1, wherein roasting is performed in the atmosphere at a roasting temperature of 350° C. or higher and 800° C. or less.

3. The method of producing mixed powder comprising noble metal powder and oxide powder according to claim 1, wherein roasting is performed in a hydrogen-containing gas atmosphere at a roasting temperature of 100° C. or higher and 500° C. or less.

4. The method of producing mixed powder comprising noble metal powder and oxide powder according to claim 3, wherein the volume of oxide to be added as a raw material is 3% to 35% of the volume of the ammonium chloride salt of the noble metal.

5. The method of producing mixed powder comprising noble metal powder and oxide powder according to claim 4, wherein the noble metal is at least one of platinum, gold, ruthenium, palladium, and iridium.

6. The method of producing mixed powder comprising noble metal powder and oxide powder according to claim 5, wherein the oxide is at least one of lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide molybdenum oxide, indium oxide, tin oxide, hafnium oxide, tantalum oxide, tungsten oxide, and bismuth oxide.

7. The method of producing mixed powder comprising noble metal powder and oxide powder according to claim 2, wherein a volume of oxide to be added as a raw material is 3% to 35% of a volume of the ammonium chloride salt of the noble metal.

8. The method of producing mixed powder comprising noble metal powder and oxide powder according to claim 7, wherein the noble metal is at least one of platinum, gold, ruthenium, palladium, and iridium.

9. The method of producing mixed powder comprising noble metal powder and oxide powder according to claim 8, wherein the oxide is at least one of lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide molybdenum oxide, indium oxide, tin oxide, hafnium oxide, tantalum oxide, tungsten oxide, and bismuth oxide.

10. The method of producing mixed powder comprising noble metal powder and oxide powder according to claim 1, wherein a volume of oxide to be added as a raw material is 3% to 35% of a volume of the ammonium chloride salt of the noble metal.

11. The method of producing mixed powder comprising noble metal powder and oxide powder according to claim 1, wherein the noble metal is at least one of platinum, gold, ruthenium, palladium, and iridium.

12. The method of producing mixed powder comprising noble metal powder and oxide powder according to claim 1, wherein the oxide is at least one of lithium oxide, boric oxide, magnesium oxide, aluminum oxide, silicon oxide, calcium oxide, scandium oxide, titanium oxide, vanadium oxide, chromic oxide, manganese oxide, zinc oxide, gallium oxide, germanium oxide, yttrium oxide, lanthanum oxide, cerium oxide, praseodymium oxide, neodymium oxide, samarium oxide, zirconium oxide, niobium oxide molybdenum oxide, indium oxide, tin oxide, hafnium oxide, tantalum oxide, tungsten oxide, and bismuth oxide.

* * * * *